US011624551B2

(12) United States Patent
Chhajed et al.

(10) Patent No.: US 11,624,551 B2
(45) Date of Patent: Apr. 11, 2023

(54) DRAINAGE ASSEMBLY

(71) Applicant: WHIRLPOOL CORPORATION, Benton Harbor, MI (US)

(72) Inventors: Rahul Chhajed, Pune (IN); Mansi Katkar, Pune (IN); Mandar Gopalkrushna Kulkarni, Pune (IN); Rafael Dutra Nunes, St. Joseph, MI (US); Sanjesh Kumar Pathak, Stevensville, MI (US); Manoj T. Sambrekar, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 17/705,941

(22) Filed: Mar. 28, 2022

(65) Prior Publication Data

US 2022/0214100 A1 Jul. 7, 2022

Related U.S. Application Data

(62) Division of application No. 17/009,972, filed on Sep. 2, 2020, now Pat. No. 11,293,688.

(51) Int. Cl.
*F25D 23/06* (2006.01)
*F25D 23/08* (2006.01)

(52) U.S. Cl.
CPC ..... *F25D 23/068* (2013.01); *F25D 23/061* (2013.01); *F25D 23/066* (2013.01); *F25D 23/08* (2013.01)

(58) Field of Classification Search
CPC .... F25D 23/068; F25D 23/061; F25D 23/066; F25D 23/08; F25D 2321/142; F25D 2321/143; F25D 2321/146; F25D 21/14; F25D 23/00; F25D 2201/14
See application file for complete search history.

(56) References Cited

U.S. PATENT DOCUMENTS

| | | | |
|---|---|---|---|
| 2,188,596 | A | 1/1940 | Hobert |
| 2,311,427 | A | 2/1943 | Winkelmeyer |
| 2,459,370 | A | 1/1949 | Ferguson et al. |
| 3,572,049 | A | 3/1971 | Moorman |
| 4,165,105 | A | 8/1979 | Hahn |
| 4,180,297 | A | 12/1979 | Abrams |
| 4,186,945 | A | 2/1980 | Hahn |
| 4,715,512 | A | 12/1987 | Buchser |
| 4,805,293 | A | 2/1989 | Buchser |

(Continued)

FOREIGN PATENT DOCUMENTS

| | | | |
|---|---|---|---|
| EP | 2476981 | A2 | 7/2012 |
| JP | 57209417 | A * | 12/1982 |

(Continued)

*Primary Examiner* — Hanh V Tran
(74) *Attorney, Agent, or Firm* — Price Heneveld LLP

(57) ABSTRACT

A drainage assembly for an insulated structure includes a flexible body that has a plurality of flexures and defines an opening and notches that extend radially from the opening. A first drainage tube extends through the opening and includes receiving flanges disposed within the notches defined by the flexible body. A second drainage tube is in fluid communication with the first drainage tube. The second drainage tube includes engagement flanges disposed within the receiving flanges of the first drainage tube.

20 Claims, 15 Drawing Sheets

(56) References Cited

U.S. PATENT DOCUMENTS

| | | | | |
|---|---|---|---|---|
| 4,843,835 | A | 7/1989 | Goetz et al. | |
| 5,000,010 | A | 3/1991 | Powell et al. | |
| 5,238,299 | A | 8/1993 | McKinney | |
| 5,466,016 | A | 11/1995 | Briody et al. | |
| 6,211,464 | B1 | 4/2001 | Mochizuki et al. | |
| 6,359,224 | B1 | 3/2002 | Beele | |
| 6,768,058 | B2 | 7/2004 | Pallapothu | |
| 7,434,814 | B2 | 10/2008 | Kumakura et al. | |
| 7,731,315 | B2 | 6/2010 | Lee et al. | |
| 9,752,818 | B2 | 9/2017 | Naik | |
| 10,359,224 | B2 | 7/2019 | Jeong | |
| 10,584,916 | B2 | 3/2020 | Gan et al. | |
| 10,830,384 | B2 | 11/2020 | Allard et al. | |
| 10,969,037 | B2 | 4/2021 | Vaughn et al. | |
| 11,175,089 | B2 * | 11/2021 | Marinello | F25D 23/061 |
| 2002/0038492 | A1 | 4/2002 | Hashimoto | |
| 2003/0097855 | A1 * | 5/2003 | Rovira-Adame | F25D 21/14 62/277 |
| 2005/0138954 | A1 * | 6/2005 | Kim | F25D 21/14 62/418 |
| 2005/0173323 | A1 | 8/2005 | Meuleners et al. | |
| 2006/0082073 | A1 | 4/2006 | Dorner et al. | |
| 2007/0169493 | A1 * | 7/2007 | Rios | F25D 21/14 62/285 |
| 2009/0241585 | A1 | 10/2009 | Diebold et al. | |
| 2009/0324871 | A1 | 12/2009 | Henn | |
| 2012/0180514 | A1 * | 7/2012 | Lee | F25D 17/047 62/291 |
| 2014/0190725 | A1 | 7/2014 | Baydoun | |
| 2014/0202191 | A1 * | 7/2014 | Jinnai | F24F 13/222 62/275 |
| 2015/0159934 | A1 | 6/2015 | Choi et al. | |
| 2016/0138846 | A1 * | 5/2016 | Kim | F25C 5/182 62/344 |
| 2016/0327193 | A1 * | 11/2016 | Chiu | F16L 25/009 |
| 2016/0377339 | A1 | 12/2016 | Kempfle | |
| 2017/0045286 | A1 * | 2/2017 | Ungor | F25D 23/061 |
| 2017/0130960 | A1 | 5/2017 | Nagano et al. | |
| 2017/0299219 | A1 * | 10/2017 | Okabe | F16K 1/38 |
| 2018/0163900 | A1 | 6/2018 | Vaughn et al. | |
| 2019/0162356 | A1 | 5/2019 | Allard et al. | |
| 2019/0204003 | A1 | 7/2019 | Okada | |
| 2020/0025436 | A1 | 1/2020 | Lee | |
| 2020/0033049 | A1 | 1/2020 | Dherde et al. | |
| 2020/0191466 | A1 * | 6/2020 | Cho | F25D 21/14 |
| 2022/0018487 | A1 * | 1/2022 | Zhang | F25D 23/068 |
| 2022/0252327 | A1 * | 8/2022 | Koch | F25D 21/14 |

FOREIGN PATENT DOCUMENTS

| | | | | |
|---|---|---|---|---|
| JP | H09243238 | A | 9/1997 | |
| JP | H11270959 | A | 10/1999 | |
| JP | 2000241066 | A * | 9/2000 | |
| JP | 2004190880 | A | 7/2004 | |
| JP | 2008006055 | A | 1/2008 | |
| KR | 200347422 | Y1 | 4/2004 | |
| WO | WO-2009053240 | A1 * | 4/2009 | F25D 21/14 |

* cited by examiner

DRAINAGE ASSEMBLY

CROSS-REFERENCE TO RELATED APPLICATION

This application is a division of U.S. Provisional application Ser. No. 17/009,972, filed on Sep. 2, 2020, now U.S. Pat. No. 11,293,688, entitled "DRAINAGE ASSEMBLY," the disclosure of which is hereby incorporated herein by reference in its entirety.

BACKGROUND OF THE DISCLOSURE

The present disclosure generally relates to an insulated structure, and more specifically, to a drainage assembly for an insulated structure.

SUMMARY OF THE DISCLOSURE

According to one aspect of the present disclosure, a drainage assembly for an insulated structure includes a flexible body that has a plurality of flexures and defines an opening and notches that extend radially from the opening. A first drainage tube extends through the opening and includes receiving flanges disposed within the notches defined by the flexible body. A second drainage tube is in fluid communication with the first drainage tube. The second drainage tube includes engagement flanges disposed within the receiving flanges of the first drainage tube.

According to another aspect of the present disclosure, a drainage assembly for an insulated structure includes a flexible body that defines an opening and notches that extend from the opening. A first drainage tube extends through the opening and includes receiving flanges disposed within the notches defined by the flexible body. A second drainage tube is in fluid communication with the first drainage tube. The second drainage tube includes engagement flanges disposed within the receiving flanges of the first drainage tube. Each of the receiving flanges of the first drainage tube defines a cavity. One engagement flange of the second drainage tube is disposed within the cavity of each receiving flange.

According to yet another aspect of the present disclosure, a drainage assembly for an insulated structure includes a flexible body that defines a drainage opening with notches that extend from the drainage opening and a pass-through opening to receive refrigeration lines therethrough. A first drainage tube extends through the drainage opening and includes receiving flanges disposed within the notches defined by the flexible body. A second drainage tube is in fluid communication with the first drainage tube. The second drainage tube includes engagement flanges disposed within the receiving flanges of the first drainage tube.

These and other features, advantages, and objects of the present disclosure will be further understood and appreciated by those skilled in the art by reference to the following specification, claims, and appended drawings.

Figure 1:
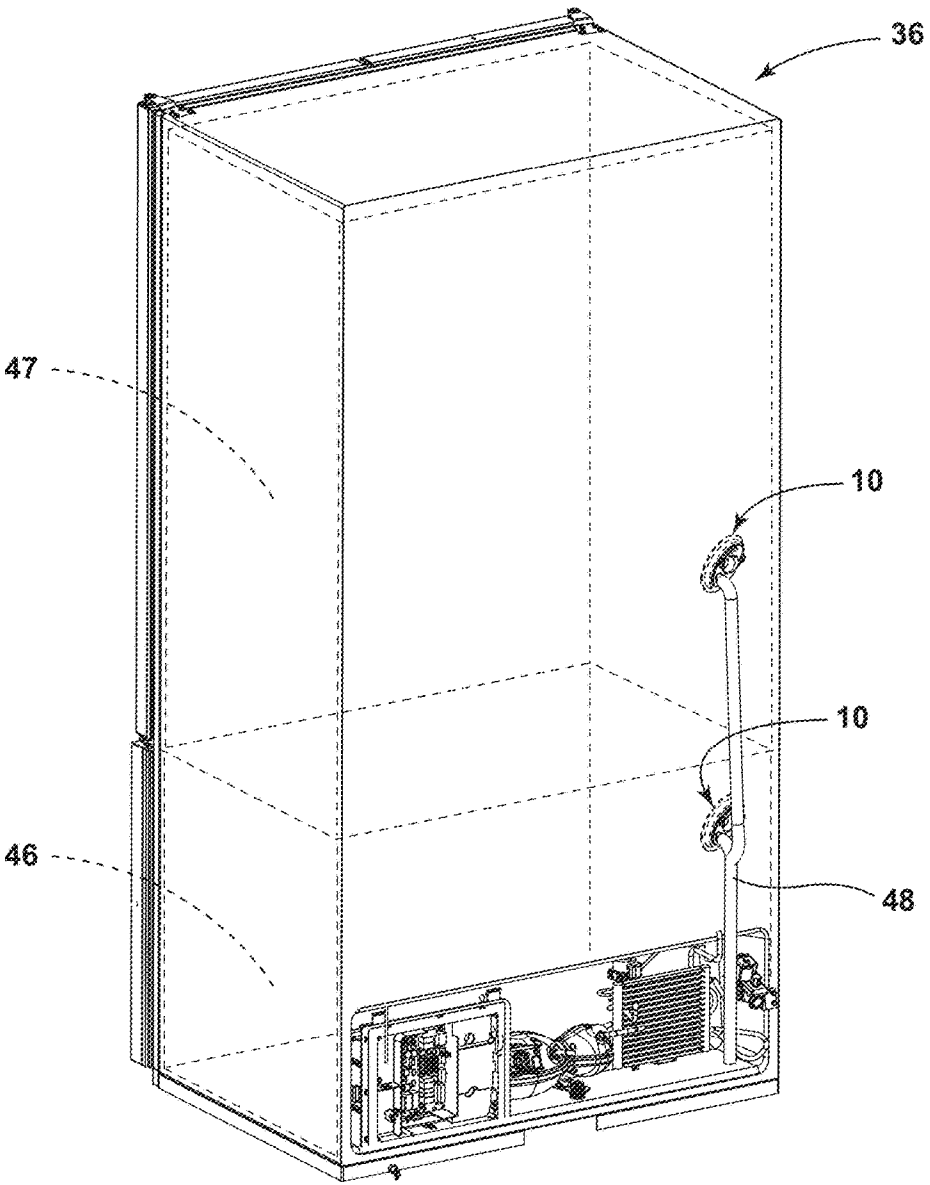
FIG. 1 is a rear top perspective view of an appliance of the present disclosure.

The components in the figures are not necessarily to scale, emphasis instead being placed upon illustrating the principles described herein.

DETAILED DESCRIPTION

The present illustrated embodiments reside primarily in combinations of apparatus components related to a drainage assembly. Accordingly, the apparatus components have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-15, reference numeral 10 generally designates a drainage assembly for an insulated structure 12. The drainage assembly 10 includes a flexible body 14 that has a plurality of flexures 16 and defines an opening 18. The flexible body 14 also defines notches 20 that extend radially from the opening 18. A first drainage tube 22 extends through the opening 18 and has receiving flanges 24 disposed within the notches 20 defined by the flexible body 14. A second drainage tube 26 is in fluid communication with the first drainage tube 22. The second drainage tube 26 has engagement flanges 28 that are disposed within the receiving flanges 24 of the first drainage tube 22. It is generally contemplated that the first drainage tube 22 may also be referred to as an outlet tube 22, and the second drainage tube 26 may be referred to as an inlet tube 26. Both the outlet tube 22 and the inlet tube 26 each include a first end 30 and a second end 32, described further below.

Figure 2:
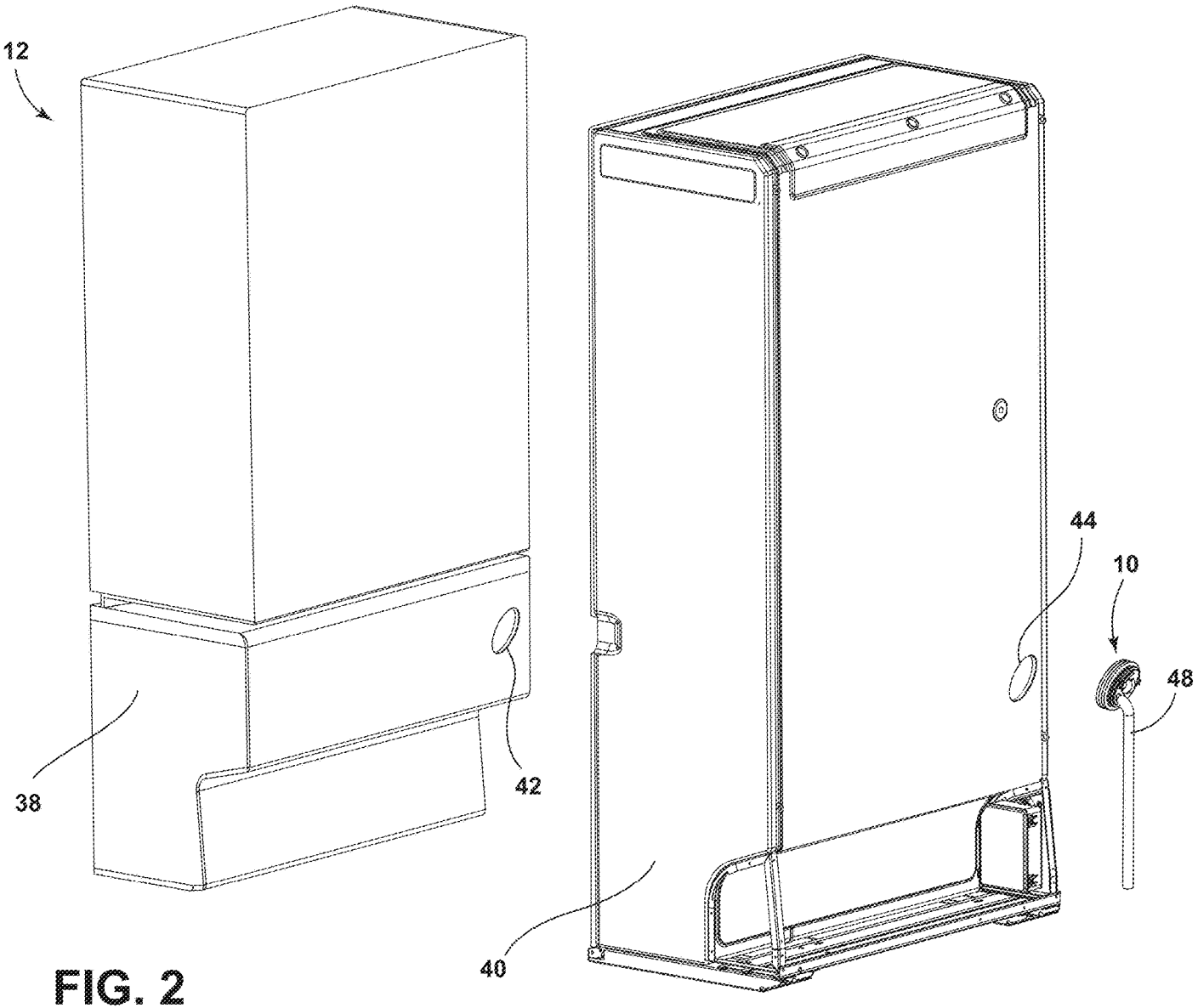
FIG. 2 is an exploded rear top perspective view of an insulated structure including a drainage assembly of the present disclosure.
Figure 3:
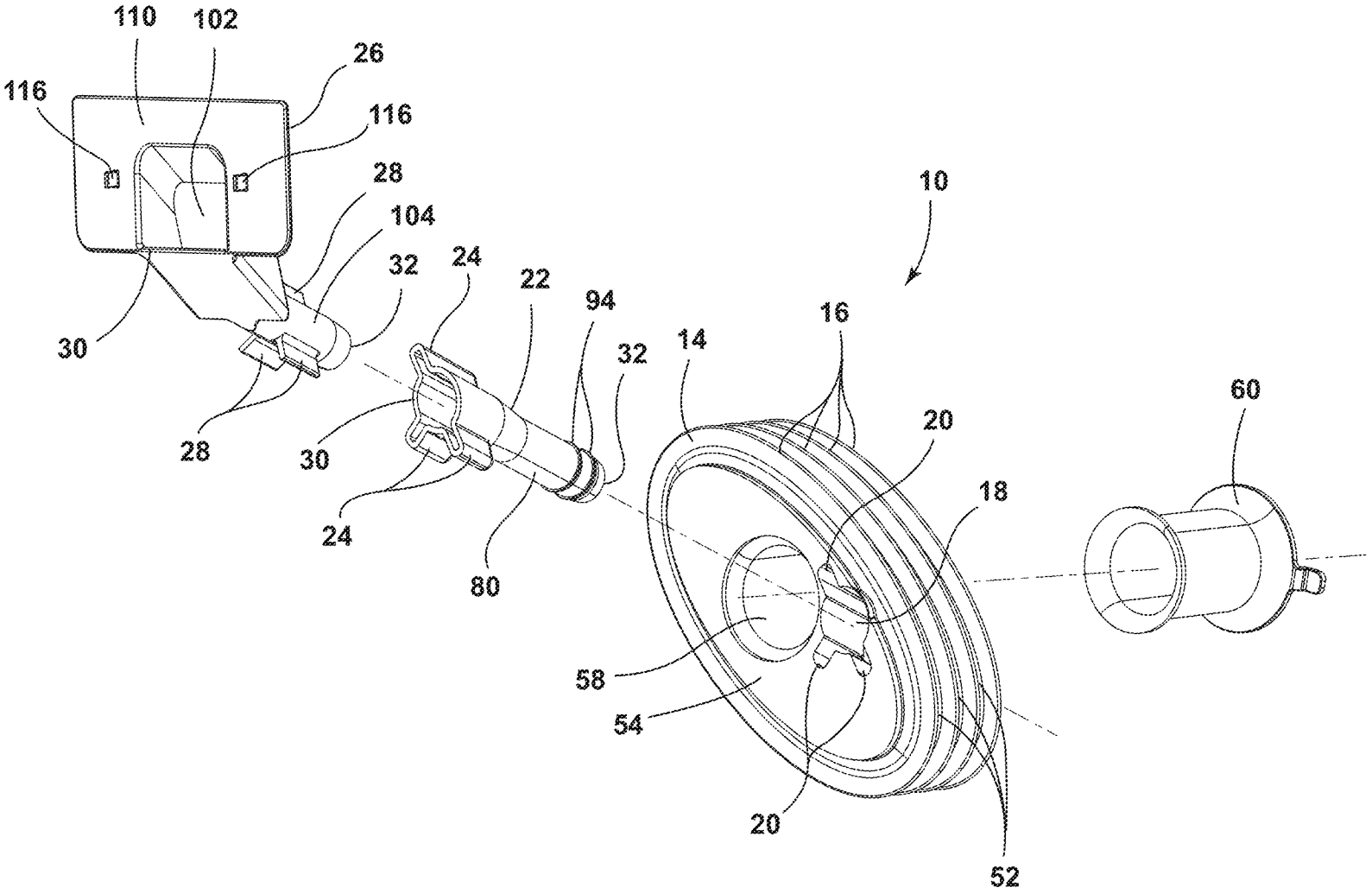
FIG. 3 is an exploded top perspective view of a drainage assembly of the present disclosure.
Figure 4:
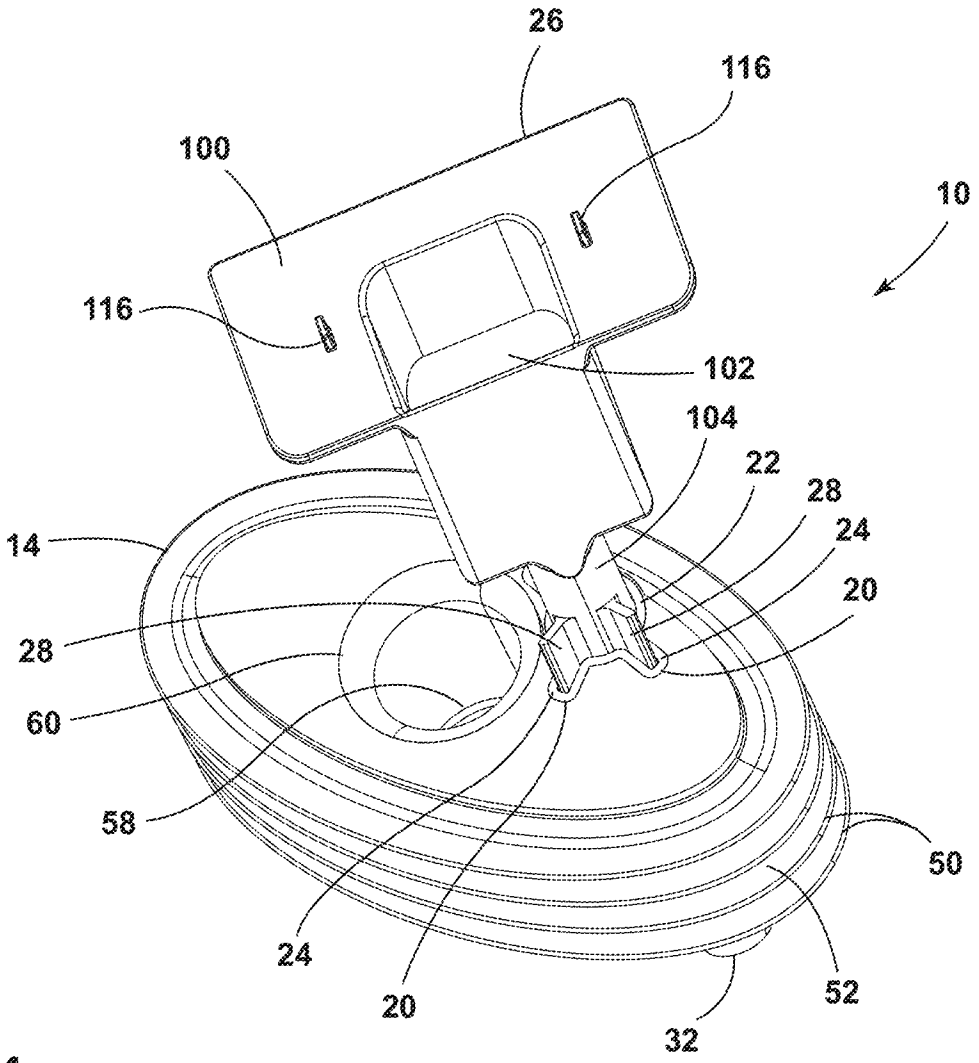
FIG. 4 is a top perspective view of the drainage assembly of FIG. 3 with an inlet tube coupled to a flexible body of the drainage assembly.
Figure 5:
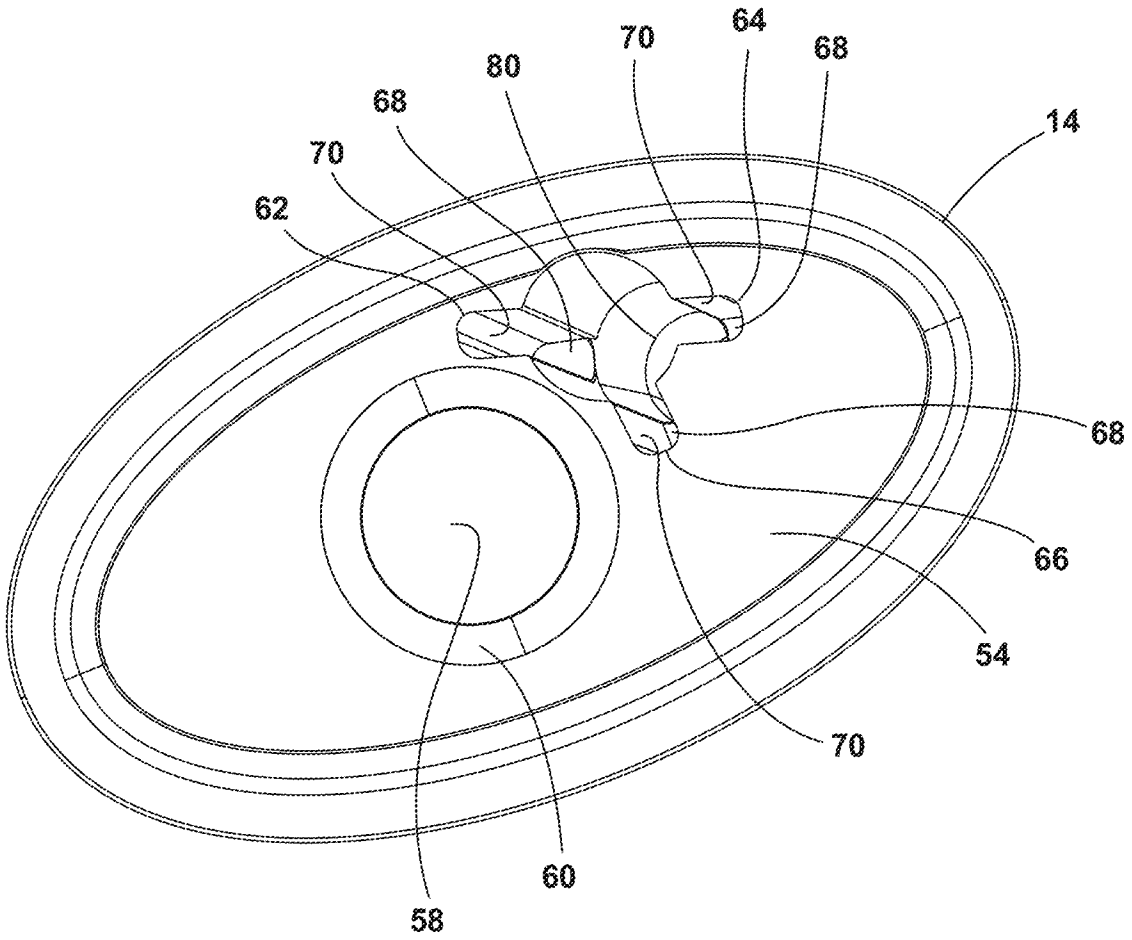
FIG. 5 is a top elevational view of a flexible body of the present disclosure that defines notches extending radially from an opening defined by the flexible body.
Figure 6:
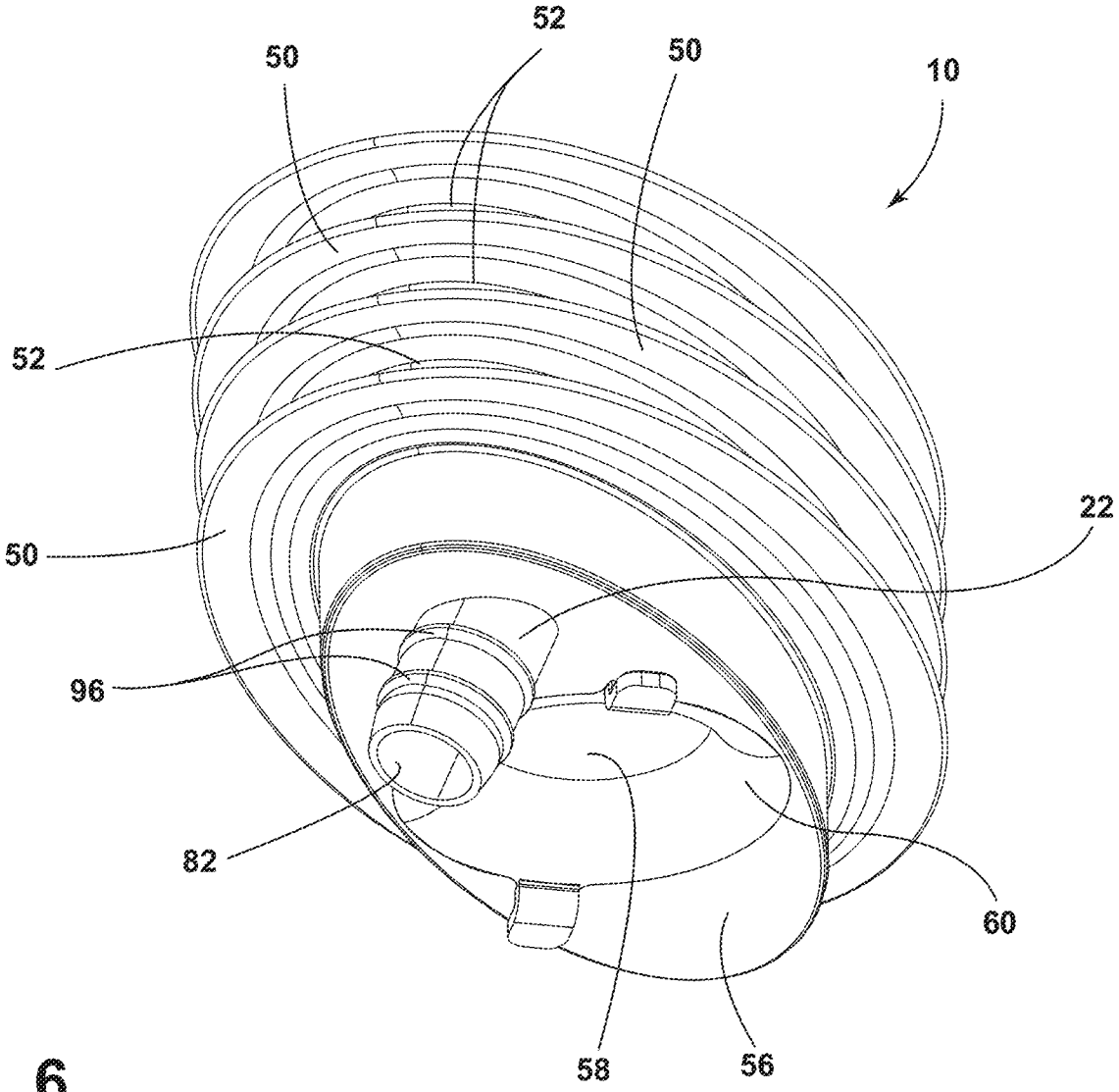
FIG. 6 is a bottom perspective view of a drainage assembly of the present disclosure.
Figure 7:
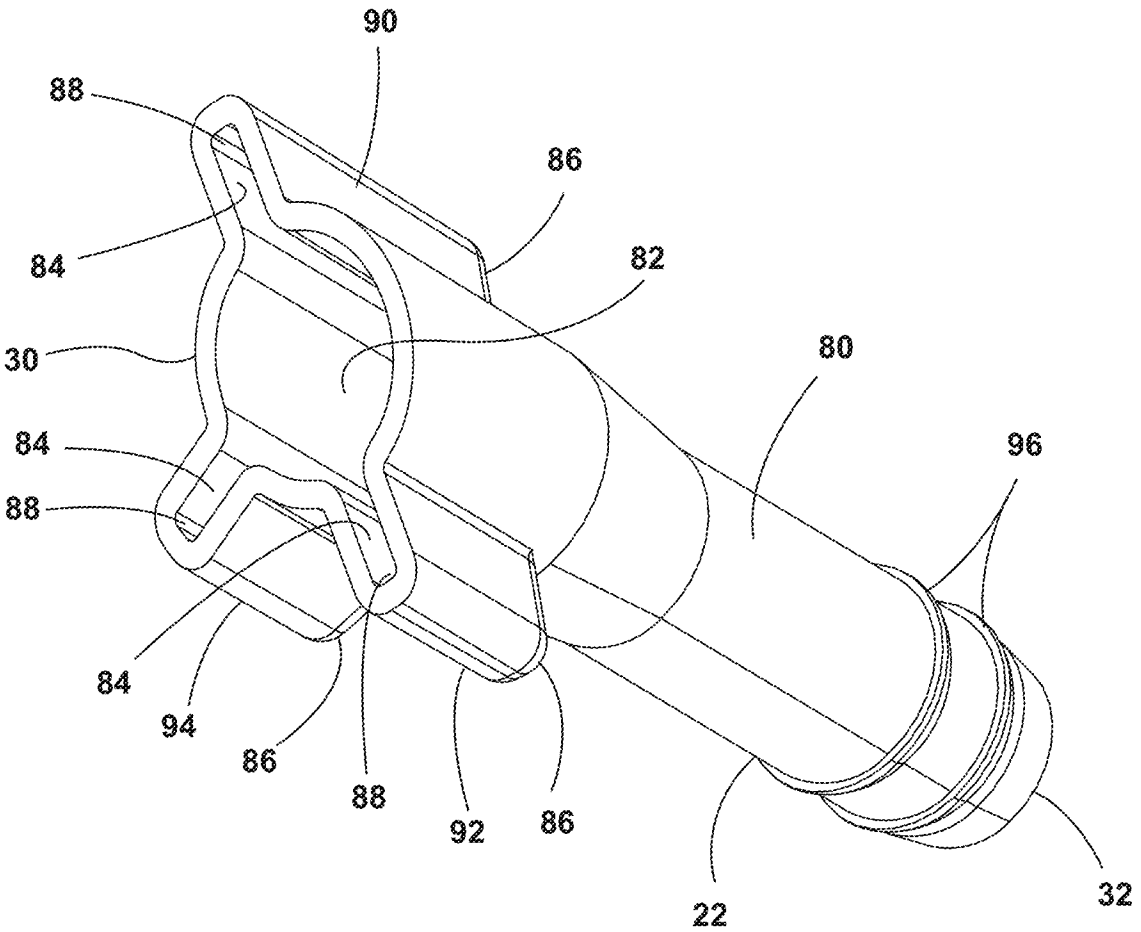
FIG. 7 is a top perspective view of an outlet tube of a drainage assembly of the present disclosure.

Referring now to FIGS. 1-3, the drainage assembly 10 is illustrated as being utilized as a part of an appliance 36 illustrated as a refrigerator. It is also contemplated that the appliance 36 may be a freezer or other cooling appliance 36 that may utilize the drainage assembly 10 to redirect liquid that has been defrosted or may otherwise be drained from the appliance 36. The appliance 36 typically includes a liner 38 and a wrapper 40 to form the insulated structure 12. It is generally contemplated that negative pressure is maintained within the insulated structure 12 between the liner 38 and the wrapper 40, such that the insulated structure 12 may be a vacuum insulated structure. The liner 38 defines a first aperture 42, and the wrapper 40 defines a second aperture 44 that generally corresponds with and is complementary to the first aperture 42. The drainage assembly 10 is positioned between and coupled to each of the liner 38 and the wrapper 40, such that the drainage assembly 10 seals the first and second apertures 42, 44 of the liner 38 and the wrapper 40, respectively. Additionally or alternatively, the liner 38 and the wrapper 40 may each define multiple apertures, such that multiple drainage assemblies 10 may be positioned between the wrapper 40 and the liner 38 in respective apertures.

As mentioned above, the illustrated appliance 36 is a refrigerator appliance. It is generally contemplated that the appliance 36 may include a freezer compartment 46 along with a refrigeration compartment 47, which typically is are configured with heaters to provide sufficient heating capacity to minimize frost build-up in the freezer and refrigeration compartments 46, 47. As the freezer compartment 46 and/or the refrigeration compartment 47 is defrosted, the liquid is directed toward the drainage assembly 10 to remove the liquid from the freezer compartment 46 and the appliance 36, as described in further detail below. It is generally contemplated that an external drainage line 48 is coupled to the outlet tube 22.

Referring to FIGS. 2-6, the flexible body 14 is generally formed to fit the general shape of the first and second apertures 42, 44. As mentioned above, the flexible body 14 includes the plurality of flexures 16 such that the flexible body 14 is formed from a flexible elastomeric and/or polymeric material to bend to fit within the first and second apertures 42, 44 of the liner 38 and the wrapper 40, respectively. The plurality of flexures 16 generally defines a corrugated pattern, such that the flexible body 14, as depicted, includes flexures 50 and corresponding depressions 52 defined between a first surface 54 and a second surface 56 of the flexible body 14. The flexures 50 and depressions 52 generally facilitate compression and bending of the flexible body 14 in order to be positioned within the first and second apertures 42, 44 of the liner 38 and the wrapper 40, respectively.

It is also contemplated that the flexible body 14 may generally have an elliptical shape. For example, as depicted in FIGS. 1 and 2, the flexible body 14 is positioned within the first and second apertures 42, 44 of the liner 38 and the wrapper 40, each of which have a generally elliptical configuration. It is also contemplated that the flexible body 14 and the first and second apertures 42, 44 may have other configurations such as circular, square, triangular, and other shapes known in the art.

The flexible body 14 also defines a pass-through opening 58 and a housing 60 through which a suction line and other refrigeration components of the appliance 36 may pass. The housing 60 may be formed from a polymeric material, such as plastic, and may be generally insulated to potential suction line heat exchangers that may pass through the housing 60 and the pass-through opening 58. The pass-through opening 58 and the housing 60 are generally adjacent to the opening 18 in which the outlet tube 22 may be positioned, described further below. As mentioned above, the flexible body 14 defines the opening 18 and notches 20 that radially extend from the opening 18. The opening 18 and the notches 20 are generally defined at an angle within the flexible body 14, such that the notches 20 may have varying depth relative to the first surface 54 of the flexible body 14.

Figure 9:
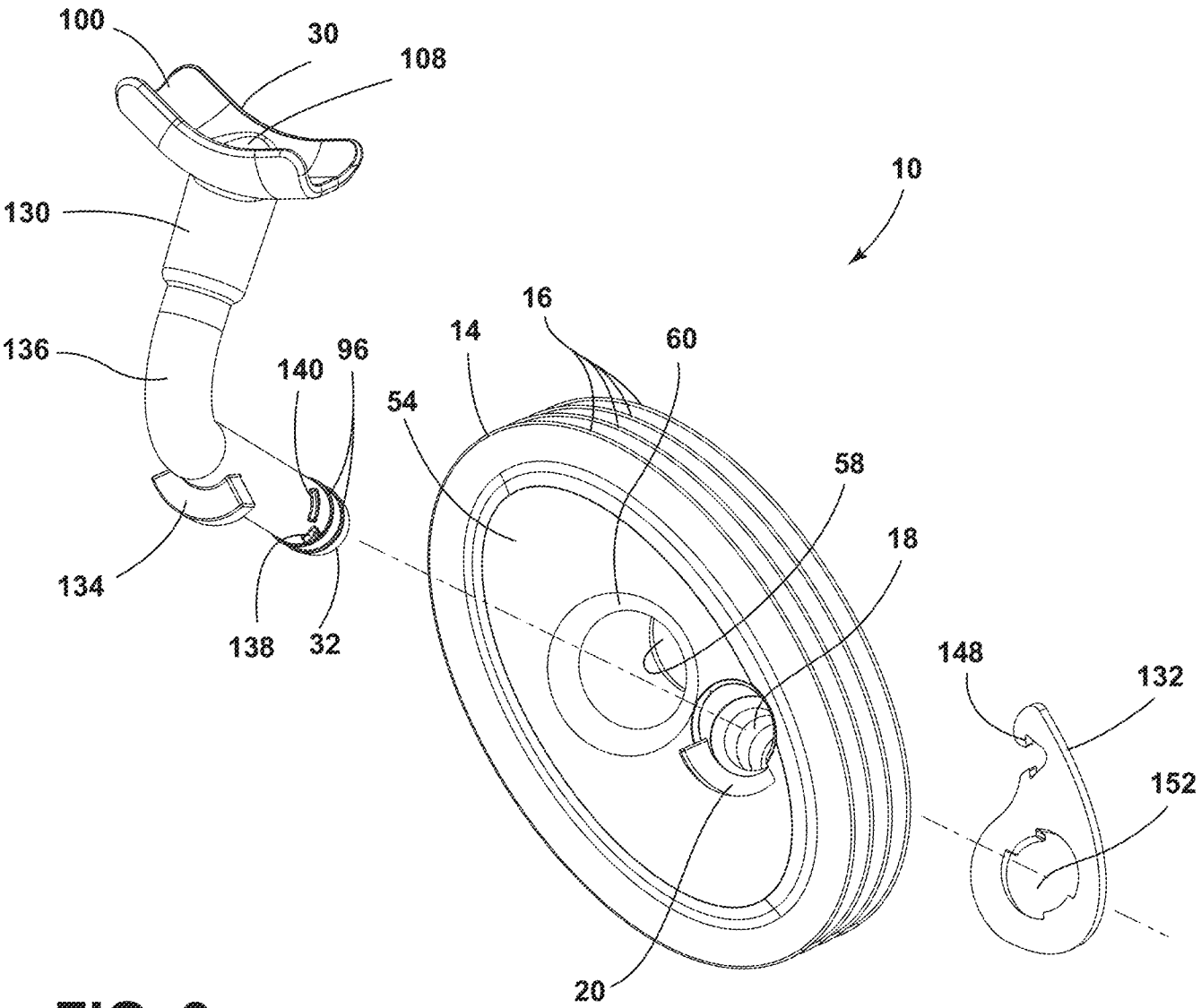
FIG. 9 is an exploded top perspective view of a drainage assembly of the present disclosure.

With further reference to FIGS. 2-6, the notches 20 may include a first notch 62, a second notch 64, and a third notch 66. The first and third notches 62, 66 may be proximate to the pass-through opening 58 and may have a greater depth than the second notch 64, as described in more detail below in reference to the outlet tube 22. Each of the notches 20 may be generally defined by a ledge 68 and surrounding sidewalls 70. In addition, each of the sidewalls 70 for each respective notch 20 may have a varied height to define the varied depth of each of the notches 20 mentioned above. Additionally or alternatively, the flexible body 14 may define a single notch 20 extending from the opening 18, as illustrated in FIG. 9 and described in more detail below.

As mentioned above, the notches 20 are generally defined on the first surface 54 of the flexible body 14. In some configurations, a projection 72 (FIG. 13) may be defined on the second surface 56, described in more detail below. Additionally or alternatively, a pull-tab 74 (FIG. 13) is defined on the second surface 56 of the flexible body 14. It is generally contemplated that the pull-tab 74 (FIG. 13) may be utilized for repositioning or removing the flexible body 14 from the liner 38 and the wrapper 40. It is further contemplated that there may be more than one pull-tab 74 (FIG. 13), such that a user may utilize either pull-tab 74 (FIG. 13) to manipulate the flexible body 14. In an additional configuration described below, the flexible body 14 may also define a recess 76 (FIG. 13) proximate to the projection 72.

Referring now to FIGS. 4-7, the outlet tube 22 includes the receiving flanges 24 outwardly extending from a tube body 80 that defines a channel 82 therethrough. The receiving flanges 24 each have an open entry portion 84, a closed base 86, and a cavity 88 defined between the open entry portion 84 and the closed base 86. The receiving flanges 24 may include a first receiving flange 90, a second receiving flange 92, and a third receiving flange 94.

It is generally contemplated that the closed base 86 of each receiving flange 24 is disposed on the ledge 68 of the respective notch 20 of the flexible body 14. By way of example, not limitation, the first receiving flange 90 is disposed on the ledge 68 of the first notch 62, such that the depth of the first receiving flange 90 generally corresponds with the depth of the first notch 62. The receiving flanges 24 are defined on the first end 30 of the tube body 80 and attachment rings 96 are defined on the second end 32 of the tube body 80. The first receiving flange 90 may be disposed approximately 180-degrees from the second receiving flange 92 about the first end 30 of the outlet tube 22.

Figure 8:
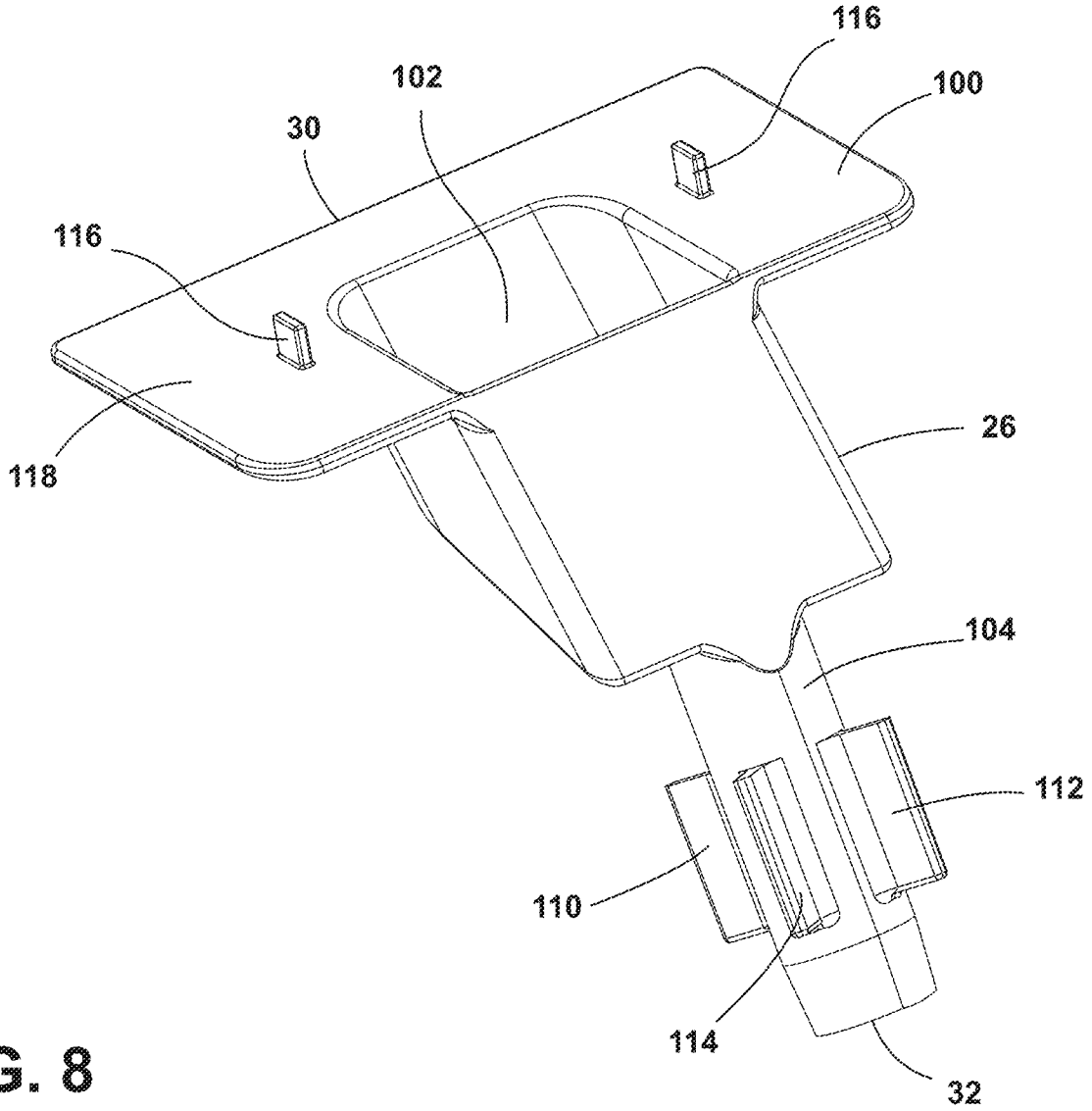
FIG. 8 is a top perspective view of an inlet tube of a drainage assembly of the present disclosure.

With further reference to FIGS. 4-7, the inlet tube 26 includes an attachment base 100 defining a collecting cavity 102, a tube body 104 defining a drainage channel 108, and the engagement flanges 28 outwardly extending from the tube body 104. The engagement flanges 28 may include a first engagement flange 110, a second engagement flange 112, and a third engagement flange 114, described below. As illustrated in FIG. 8, the attachment base 100 is generally planar and defines the collecting cavity 102 from which the tube body 104 extends. The attachment base 100 may also have attachment tabs 116 outwardly extending from a planar surface 118 of the attachment base 100. The attachment tabs 116 of the attachment base 100 are configured to couple the attachment base 100 to the freezer compartment 46 (FIG. 1) and/or the refrigeration compartment 47 of the appliance 36 (FIG. 1).

The inlet tube 26 is operably coupled to the outlet tube 22 and is configured to direct the drained liquid from the appliance 36 (FIG. 1) via the external drainage line 48 (FIG. 2). The inlet tube 26 is positioned within the first end 30 of the outlet tube 22, and the external drainage line 48 (FIG. 2) may be coupled to the attachment rings 96 of the outlet tube 22. The external drainage line 48 (FIG. 2) generally removes drained liquid from the appliance 36 (FIG. 2) via the drainage assembly 10. The inlet tube 26 is coupled to the freezer compartment 46 (FIG. 1) and/or the refrigeration compartment 47 (FIG. 1) via the attachment tabs 116 and collects the liquid within the collecting cavity 102. The liquid is passed through the drainage channel 108 of the inlet tube 26 to the outlet tube 22 and out of the appliance 36 through the external drainage line 48.

With reference again to FIGS. 3-5 and 8, the receiving flanges 24 of the outlet tube 22 are disposed within the notches 20 of the flexible body 14 to define an interlocking arrangement. Stated differently, the outlet tube 22 is fixedly disposed within the flexible body 14, such that the receiving flanges 24 are retained by the sidewalls 70 of the notches 20. Upon potential articulation or movement of the outlet tube 22, the receiving flanges 24 may engage the sidewalls 70 of the notches 20 of the flexible body 14, and the receiving flanges 24 may engage the ledges 68 of each notch 20 upon any potential rearward movement of the outlet tube 22. Once the outlet tube 22 is disposed within the flexible body 14, the inlet tube 26 may be positioned within and coupled to the outlet tube 22.

It is generally contemplated that the tube body 104 of the inlet tube 26 may be smaller than the tube body 80 of the outlet tube 22, such that the tube body 104 of the inlet tube 26 may be disposed within the tube body 80 of the outlet tube 22. The engagement flanges 28 of the inlet tube 26 are configured to be disposed within the receiving flanges 24 of the outlet tube 22 via the respective open entry portions 84. Each engagement flange 28 may engage the closed base 86 of each of the receiving flanges 24. Stated differently, each engagement flange 28 may generally abut the respective closed base 86 of the outlet tube 22, such that the engagement flanges 28 may be completely and/or partially disposed within the receiving flanges 24. Specifically, as illustrated in FIG. 3, the second and third engagement flanges 112, 114 partially extend from the second and third receiving flanges 92, 94. Additionally or alternatively, the engagement flanges 28 may be fully disposed within the respective receiving flanges 24. The arrangement of the engagement flanges 28 within the receiving flanges 24 may generally be related to the angled connection between the inlet tube 26 and the outlet tube 22.

With further reference to FIGS. 4-8, an interlocking arrangement of the inlet and outlet tubes 26, 22 may be defined by the positioning of each engagement flange 28 within the respective cavity 88 defined by each of the receiving flanges 24. The interlocking arrangement between the outlet tube 22 and the inlet tube 26, as well as the interlocking arrangement between the outlet tube 22 and the flexible body 14, minimizes the potential rotation of the flexible body 14 within the first and second apertures 42, 44 (FIG. 2). For example, the inlet tube 26 is coupled to the freezer compartment 46 (FIG. 1), which ultimately stabilizes the outlet tube 22 as the outlet tube 22 is coupled to the inlet tube 26. Further, the interlocking arrangement between the inlet tube 26 and the outlet tube 22 stabilizes the flexible body 14 within the first and second apertures 42, 44 as the engagement flanges 28 are fixedly coupled to the receiving flanges 24, which are fixedly coupled to the flexible body 14. The interlocking arrangements minimize potential rotation of the flexible body 14 within the first and second apertures 42, 44 (FIG. 2) of the liner 38 (FIG. 2) and the wrapper 40 (FIG. 2).

Figure 10:
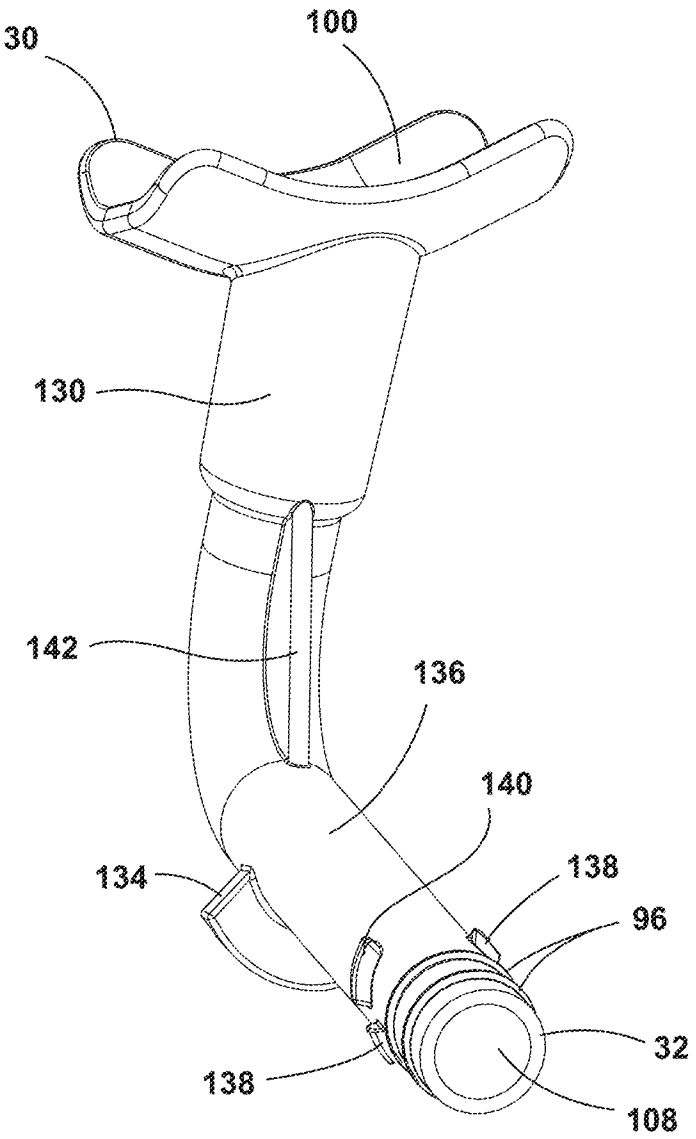
FIG. 10 is a top perspective view of a drainage tube of the present disclosure.

Referring to FIGS. 9 and 10 and in an additional or alternative configuration of the drainage assembly 10, the drainage assembly 10 may include a single drainage tube 130, the flexible body 14, and a locking feature 132. As mentioned above, and as illustrated with respect to FIG. 9, the flexible body 14 defines a notch 20 proximate to the opening 18. The illustrated notch 20 is generally arcuate in shape; however, it is also contemplated that the notch 20 may be rectangular, square, circular, or any other shape generally regarded within the art. The drainage tube 130 includes a retention flange 134 extending from a tube body 136. The drainage tube 130 may also define locking projections 138 and an abutment member 140 extending from the tube body 136 and configured to engage the locking feature 132, as described in more detail below. The drainage tube 130 may have the attachment rings 96, mentioned above, extending around the second end 32 of the tube body 136, such that the external drainage line 48 (FIG. 2) may be coupled to the drainage tube 130 via the attachment rings 96.

Figure 11:
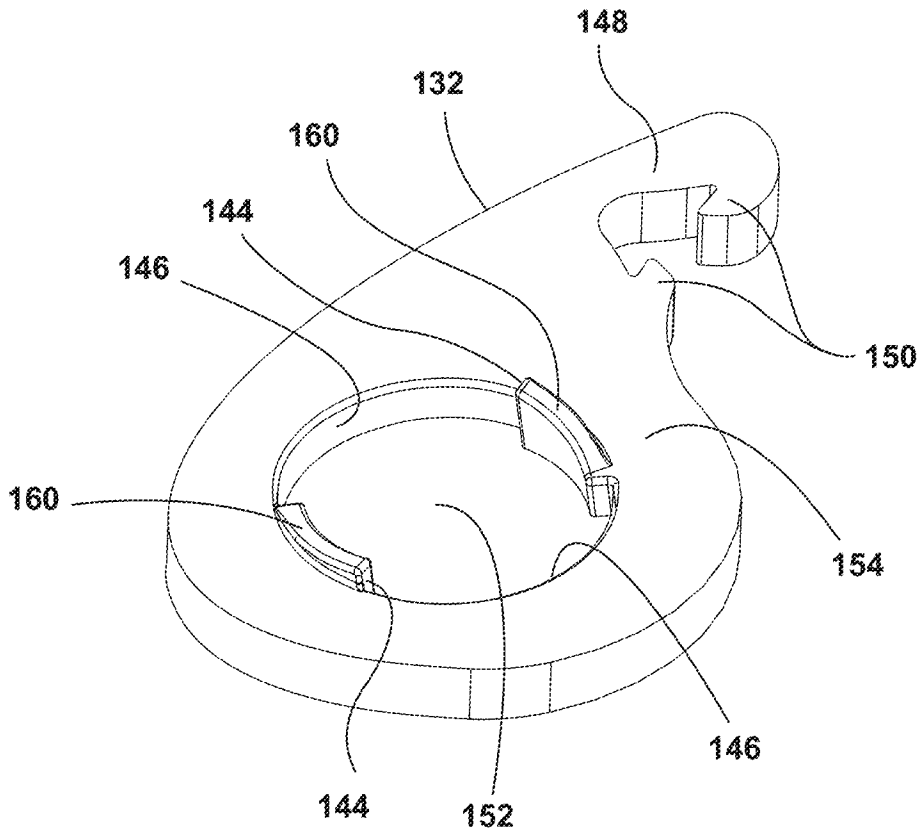
FIG. 11 is a top perspective view of a locking feature of the present disclosure.
Figure 12:
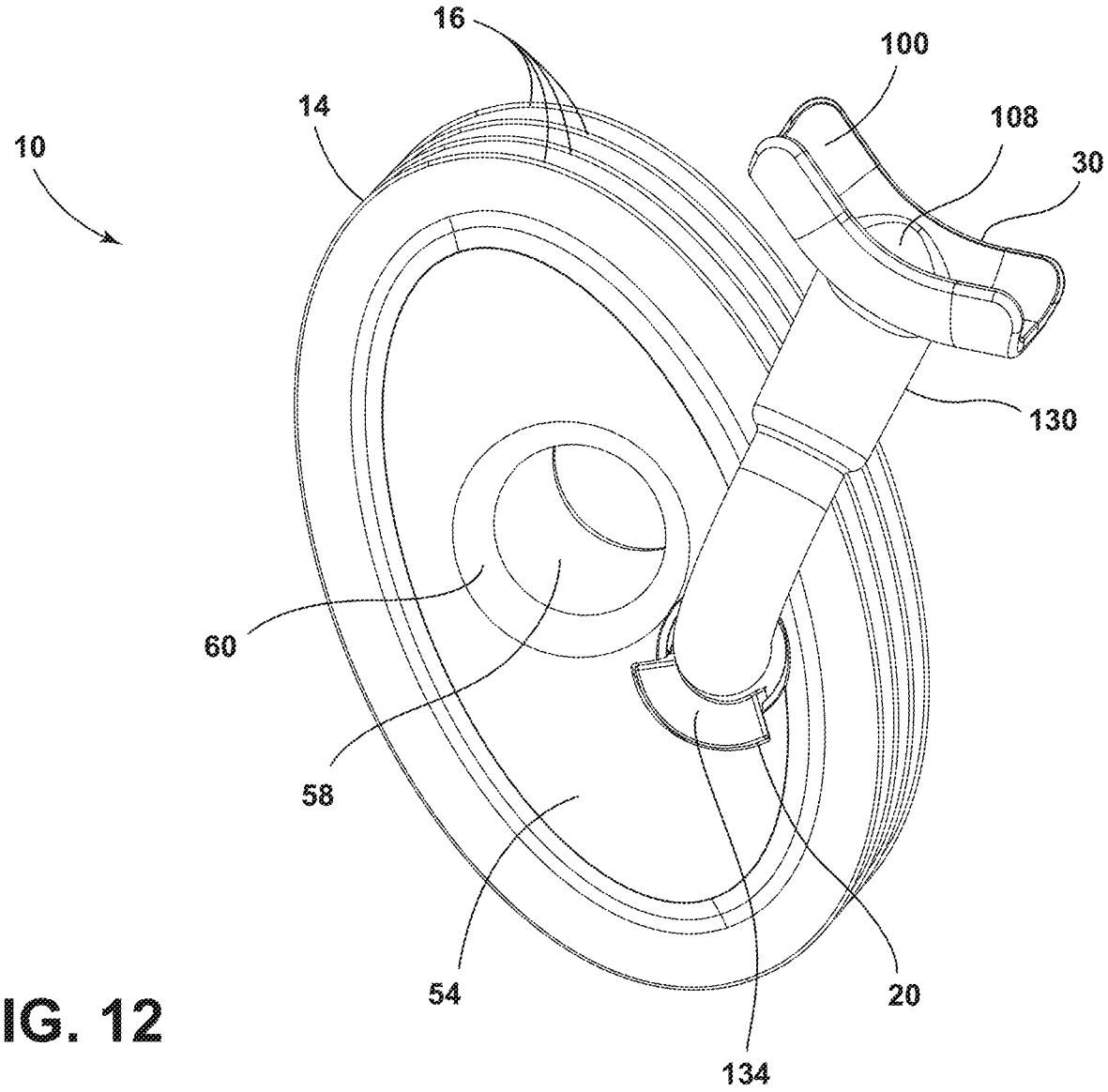
FIG. 12 is a top perspective view of a drainage assembly of the present disclosure.

The drainage tube 130 includes the attachment base 100 to couple the drainage tube 130 to the appliance 36 (FIG. 1) and generally directs liquid from the appliance 36 (FIG. 1) through the drainage tube 130. As illustrated in FIG. 11, the attachment base 100 is depicted as being generally concave, such that the liquid may be collected and directed to the drainage channel 108 defined by the attachment base 100 and the tube body 136. The drainage tube 130 is illustrated as having a generally rectilinear shape and may include a bracing member 142 to provide structural support for the drainage tube 130. It is also contemplated that the drainage tube 130 may have alternate shapes and configurations, such as the generally linear shape of the first drainage tube 22 (FIG. 3) and the generally angular shape of the second drainage tube 26 (FIG. 3), described above.

With reference to FIGS. 12-15, the locking feature 132 is operably coupled to the flexible body 14 and selectively coupled to the drainage tube 130. As mentioned above, the locking feature 132 is disposed in the recess 76 defined by the flexible body 14. The locking feature 132 includes inclined edges 144 defining spaces 146 therebetween and a clip 148. The clip 148 may have tabs 150, described in more detail below. The locking feature 132 defines a central void 152 through which the drainage tube 130 extends. The locking feature 132 also has a face 154 defined by the angled extension of the inclined edges 144, such that the inclined edges 144 outwardly extend from the face 154 of the locking feature 132. The locking feature 132 is rotatable within the recess 76 of the flexible body 14, such that the locking feature 132 rotates about the drainage tube 130 between a first position 156 and a second position 158. Stated differently, the locking feature 132 is rotatable between a first, locked position 156 and a second, unlocked position 158.

By way of example, and not limitation, the locking feature 132 may be positioned around the second end 32 of the drainage tube 130 in the unlocked position 158, such that the locking projections 138 of the drainage tube 130 are positioned within the spaces 146 defined between each of the inclined edges 144 of the locking feature 132. The locking feature 132 may be selectively removed from or disposed on the flexible body 14 in the unlocked position 158. The inclined edges 144 of the locking feature 132 are at least partially raised relative to the face 154 of the locking feature 132, such that the inclined edges 144 may partially extend from the face 154 of the locking feature 132. It is generally contemplated that the inclined edges 144 may define an acute angle between an engagement surface 160 of the inclined edges 144 and the face 154 of the locking feature 132. The inclined edges 144 of the locking feature 132 selectively engage the locking projections 138 defined by the drainage tube 130 in the locked position 156, such that the locking projections 138 translate along the engagement surfaces 160 of each inclined edge 144.

Figure 13:
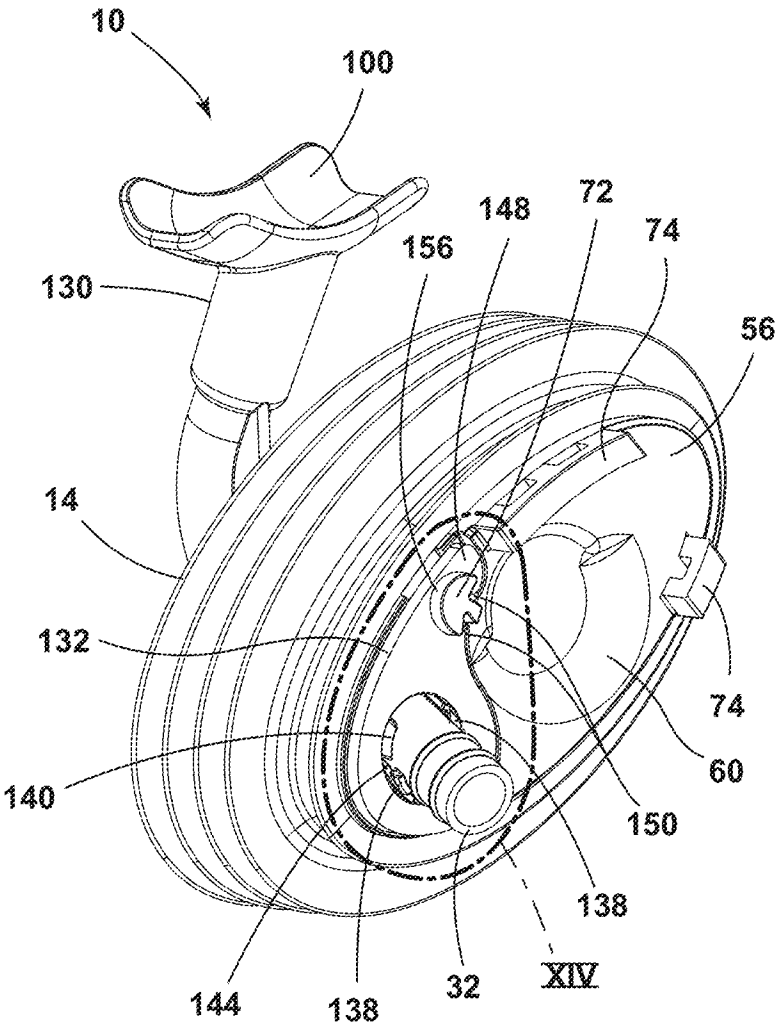
FIG. 13 is a top rear perspective view of the drainage assembly of FIG. 12 with a locking feature in a first position.
Figure 14:
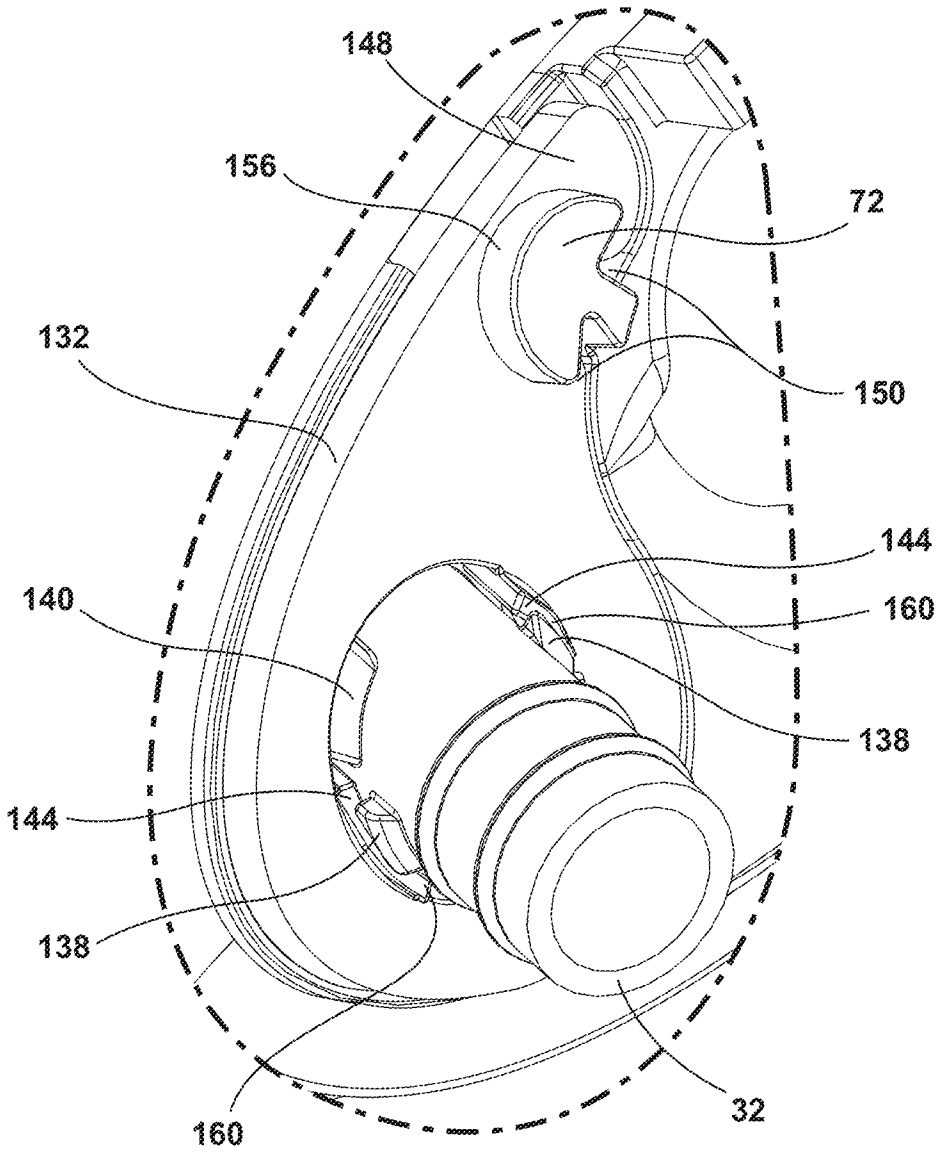
FIG. 14 is an enlarged view of the locking feature of FIG. 13 taken at area XIV.
Figure 15:
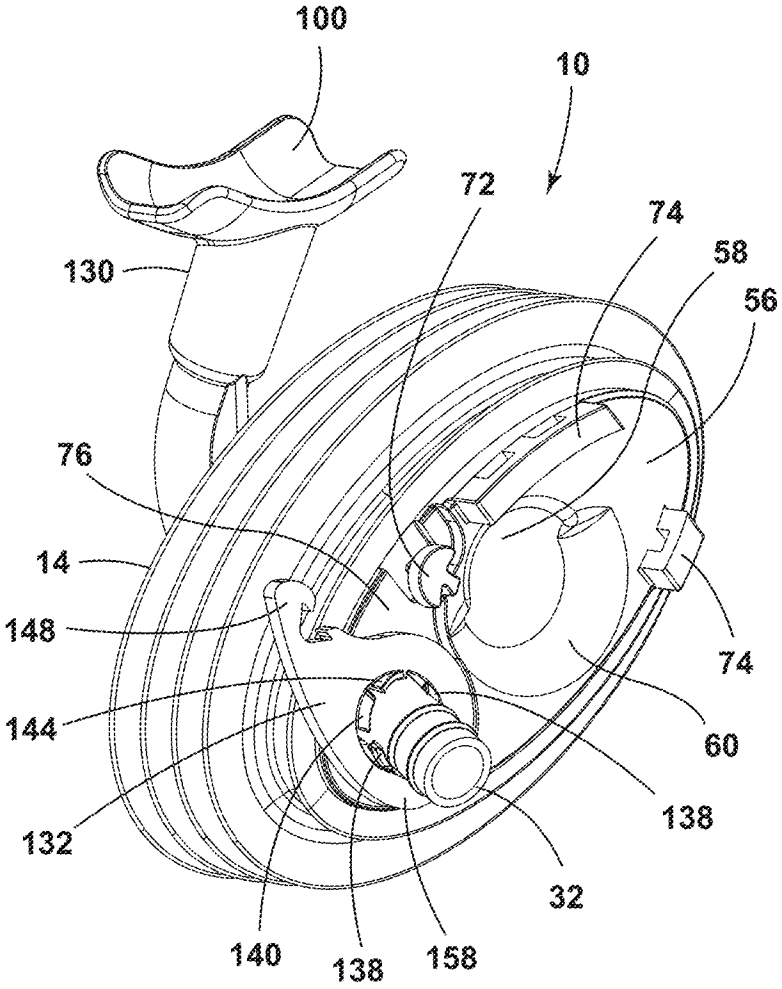
FIG. 15 is a top rear perspective view of the drainage assembly of FIG. 13 with the locking feature in a second position.

With further reference to FIGS. 13-14, the gradual incline of the inclined edges 144 facilitates the rotation of the locking feature 132 between the locked position 156 and the unlocked position 158 relative to the drainage tube 130, such that as the locking feature 132 rotates about the drainage tube 130 the locking projections 138 of the drainage tube 130 engage the engagement surface 160 of each inclined edge 144. As the locking feature 132 approaches the locked position 156 an interference engagement is defined between the inclined edges 144 and the locking projections 138, such that the locking projections 138 may be selectively limited to a position on the inclined edges 144. In addition, the drainage tube 130 may include the abutment member 140 that may abut at least one of the inclined edges 144 in the locked position 156 of the locking feature 132.

The abutment member 140 may minimize the potential strain that may result from the locking feature 132 being rotated into the locked position 156. Specifically, the abutment member 140 minimizes the potential for the locking projections 138 of the drainage tube 130 to be altered under the rotational pressure of the locking feature 132. The rotation of the locking feature 132 is further controlled via the clip 148 selectively coupling to the projection 72 defined on the flexible body 14. The tabs 150 of the clip 148 are generally flexible, such that the tabs 150 may flex apart and snap back into place as the clip 148 is positioned around the projection 72. The clip 148 retains the locking feature 132 in place to fixedly couple the drainage tube 130 to the flexible body 14. The coupling of the clip 148 to the projection 72 minimizes potential rotation of the locking feature 132 from the locked position 156 to the unlocked position 158. Thus, the clip 148 and the locking feature 132 may fixedly couple the drainage tube 130 to the flexible body 14.

Referring again to FIGS. 1-14, the drainage assembly 10 generally provides a secure drainage system for the appliance 36, such that the flexible body 14 may be easily positioned and adjusted within the insulated structure 12. The attachment of either the first and second drainage tubes 22, 26, or the single drainage tube 130, guides the positioning of the flexible body 14 within the insulated structure 12 as a result of the notches 20 guiding the assembly of the drainage assembly 10. Further, potential rotation of the flexible body 14 is minimized as a result of the attachment with the drainage tube 130 or the first and second drainage tubes 22, 26, as each is coupled to the appliance 36 and fixedly coupled to the flexible body 14.

The invention disclosed herein is further summarized in the following paragraphs and is further characterized by combinations of any and all of the various aspects described therein.

According to one aspect of the present disclosure, a drainage assembly for an insulated structure includes a flexible body that has a plurality of flexures and defines an opening and notches that extend radially from the opening. A first drainage tube extends through the opening and has receiving flanges disposed within the notches defined by the flexible body. A second drainage tube is in fluid communication with the first drainage tube. The second drainage tube has engagement flanges disposed within the receiving flanges of the first drainage tube.

According to another aspect, each receiving flange of a first drainage tube defines a cavity. One engagement flange of a second drainage tube is disposed within the cavity of each receiving flange.

According to another aspect, notches of a flexible body, receiving flanges of a first drainage tube, and engagement flanges of a second drainage tube define an interlocking arrangement that are configured to minimize rotation of the flexible body.

According to another aspect, receiving flanges include first, second, and third receiving flanges. The first and second receiving flanges are disposed approximately 180-degrees from each other about a first drainage tube.

According to another aspect, engagement flanges include first, second, and third engagement flanges. The first and second engagement flanges are disposed within first and second receiving flanges, respectively.

According to another aspect, a greater portion of a first engagement flange is disposed within a flexible body as compared to second and third engagement flanges.

According to another aspect, a plurality of flexures include flexures and depressions. The flexures and depressions are configured to facilitate compression and bending of a flexible body.

According to another aspect of the present disclosure, a drainage assembly for an insulated structure includes a flexible body that defines a drainage opening and a notch that extends from the draining opening. The flexible body includes a projection proximate to the drainage opening. A tube has an entry end and an exit end. The tube is disposed within the drainage opening. The tube includes a flange that is disposed within the notch of the flexible body. A locking feature has a central void and is disposed proximate the exit end of the tube and is rotatable between a first position and a second position.

According to another aspect, a tube further includes locking projections that extend outwardly from the tube proximate the exit end.

According to another aspect, a locking feature includes inclined edges disposed within a central void of the locking feature. Locking projections of a tube selectively engage the inclined edges in a locked configuration.

According to another aspect, a locking feature includes a clip that has tabs that selectively couple the locking feature to a projection of a flexible body.

According to another aspect, a body further includes a pull tab proximate to a projection.

According to another aspect, a locking feature is coupled to a projection and is engaged with a tube in a second position.

According to another aspect, a tube defines locking projections that engage a locking feature in a second position.

According to yet another aspect of the present disclosure, an insulated structure includes a wrapper that defines a first aperture. A liner defines a second aperture and is coupled to the wrapper. A negative pressure is maintained between the wrapper and the liner. A drainage assembly extends between the liner and the wrapper and is disposed within the first aperture and the second aperture. The drainage assembly includes a flexible body that has a plurality of flexures, first and second surfaces, and an opening that is defined between the first and second surfaces. The flexible body has at least one notch that is defined on the first surface that extends from a portion of the opening. A drainage tube extends through the opening that is defined by the flexible body and is operably coupled to the flexible body. The drainage tube includes at least one flange disposed within the at least one notch of the flexible body.

According to another aspect, at least one notch of a flexible body includes a plurality of notches that extend radially from an opening. At least one flange of a drainage tube includes receiving flanges and engagement flanges.

According to another aspect, receiving flanges are positioned on an outlet tube and are disposed within a plurality of notches. Engagement flanges are positioned on an inlet tube and are disposed within the receiving flanges operably coupling the inlet tube to the outlet tube.

According to another aspect, a second surface of a flexible body defines a recess and a projection proximate to a recess.

According to another aspect, a drainage assembly includes a locking feature that is rotatably coupled to a drainage tube and is disposed in a recess defined by a second surface of a flexible body. The locking feature selectively couples to a projection of the flexible body.

According to another aspect, a locking feature includes inclined edges and a drainage tube that includes locking projections selectively engaging the inclined edges of the locking feature in a locked position of the locking feature.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A drainage assembly for an insulated structure, comprising:

a flexible body having a plurality of flexures and defining an opening and notches extending radially from the opening;

a first drainage tube extending through the opening and having receiving flanges disposed within the notches defined by the flexible body; and a second drainage tube in fluid communication with the first drainage tube, the second drainage tube having engagement flanges disposed within the receiving flanges of the first drainage tube.

2. The drainage assembly of claim 1, wherein each of the receiving flanges of the first drainage tube defines a cavity, and wherein one engagement flange of the second drainage tube is disposed within the cavity of each receiving flange.

3. The drainage assembly of claim 1, wherein the notches of the flexible body, the receiving flanges of the first drainage tube, and the engagement flanges of the second drainage tube define an interlocking arrangement configured to minimize rotation of the flexible body.

4. The drainage assembly of claim 1, wherein the receiving flanges include first, second, and third receiving flanges, and wherein the first and second receiving flanges are disposed approximately 180-degrees from each other about the first drainage tube.

5. The drainage assembly of claim 4, wherein the engagement flanges include first, second, and third engagement flanges, and wherein the first and second engagement flanges are disposed within the first and second receiving flanges, respectively.

6. The drainage assembly of claim 5, wherein a greater portion of the first engagement flange is disposed within the flexible body as compared to the second and third engagement flanges.

7. The drainage assembly of claim 1, wherein the plurality of flexures include flexures and depressions, and wherein the flexures and depressions are configured to facilitate compression and bending of the flexible body.

8. A drainage assembly for an insulated structure, comprising:

a flexible body defining an opening and notches extending from the opening;

a first drainage tube extending through the opening and having receiving flanges disposed within the notches defined by the flexible body; and a second drainage tube in fluid communication with the first drainage tube, the second drainage tube having engagement flanges disposed within the receiving flanges of the first drainage tube, wherein each of the receiving flanges of the first drainage tube defines a cavity, and wherein one engagement flange of the second drainage tube is disposed within the cavity of each receiving flange.

9. The drainage assembly of claim 8, further comprising:

a plurality of flexures and depressions, wherein the flexures and depressions are configured to facilitate compression and bending of the flexible body.

10. The drainage assembly of claim 8, wherein the notches of the flexible body, the receiving flanges of the first drainage tube, and the engagement flanges of the second drainage tube define an interlocking arrangement.

11. The drainage assembly of claim 8, wherein the receiving flanges include first and second receiving flanges that are disposed approximately 180-degrees from each other about the first drainage tube.

12. The drainage assembly of claim 11, wherein the engagement flanges include first and second engagement flanges, and wherein the first and second engagement flanges are disposed within the first and second receiving flanges, respectively.

13. The drainage assembly of claim 12, wherein a greater portion of the first engagement flange is disposed within the flexible body as compared to the second and third engagement flanges.

14. The drainage assembly of claim 8, wherein the receiving flanges are defined on a first end of the first drainage tube and attachment rings are defined on a second end of the first drainage tube.

15. The drainage assembly of claim 8, wherein the second drainage tube includes an attachment base defining a collecting cavity.

16. A drainage assembly for an insulated structure, comprising:

a flexible body defining a drainage opening with notches extending from the drainage opening and a pass-through opening to receive refrigeration lines therethrough;

a first drainage tube extending through the drainage opening and having receiving flanges disposed within the notches defined by the flexible body; and a second drainage tube in fluid communication with the first drainage tube, the second drainage tube having engagement flanges disposed within the receiving flanges of the first drainage tube.

17. The drainage assembly of claim 16, wherein the notches of the flexible body, the receiving flanges of the first drainage tube, and the engagement flanges of the second drainage tube define an interlocking arrangement.

18. The drainage assembly of claim 16, further comprising:

an attachment base that defines a collecting cavity from which an inlet tube extends.

19. The drainage assembly of claim 18, wherein the attachment base includes attachment tabs that outwardly extend from a planar surface of the attachment base.

20. The drainage assembly of claim 16, wherein the flexible body has a generally elliptical shape.

* * * * *